United States Patent [19]

Neuhouser

[11] 4,422,706

[45] Dec. 27, 1983

[54] ELECTRICAL CONNECTOR PLUG WITH RECEPTACLE ASSEMBLY

[75] Inventor: Don E. Neuhouser, Point Pleasant, W. Va.

[73] Assignee: Power Distribution Products, Inc., Point Pleasant, W. Va.

[21] Appl. No.: 271,385

[22] Filed: Jun. 8, 1981

[51] Int. Cl.[3] ..... H01R 13/58

[52] U.S. Cl. ..... 339/107; 339/186 M; 339/208

[58] Field of Search ..... 339/103 R, 103 M, 107, 339/138, 206 R, 141, 208, 210 R, 210 M, 103 C, 49 R, 252 R, 255 R, 184 M, 186 M, 49 B, 10, 49 R

[56] References Cited

U.S. PATENT DOCUMENTS

| | | | |
|---|---|---|---|
| 1,629,086 | 5/1977 | Wohl et al. | 339/141 X |
| 2,090,761 | 8/1937 | Lewyt | 339/138 X |
| 3,775,733 | 11/1973 | Ege | 339/210 M X |
| 3,855,566 | 12/1974 | Richardson | 339/49 R |
| 3,984,169 | 10/1976 | Armstrong et al. | 339/184 M |

FOREIGN PATENT DOCUMENTS

| | | | |
|---|---|---|---|
| 245800 | 7/1947 | Switzerland | 339/255 R |

*Primary Examiner*—Eugene F. Desmond

*Attorney, Agent, or Firm*—Cushman, Darby & Cushman

[57] ABSTRACT

An electrical plug and receptacle assembly in which the number of different parts is minimized, is characterized by the use of an identical insulator in both the plug housing and the receptacle housing. The insulator has contact compartments adapted to mount either male or female contacts. Both the male and female contacts include an integral cable terminal. Additionally, the female contacts are segmented and include spring means for biasing the female contacts into tight engagement with male contacts. A cable clamp is also provided with the plug assembly which can effectively clamp either round or flat cables.

8 Claims, 11 Drawing Figures

ELECTRICAL CONNECTOR PLUG WITH RECEPTACLE ASSEMBLY

BACKGROUND OF THE INVENTION

The present invention relates to an electrical connector plug and receptacle assembly, and in particular relates to such an assembly for high current applications in which manufacturing and inventory costs are reduced.

Electrical connector plug and socket assemblies are used in a variety of applications where it is desirable to facilitate configuring the plug and receptacle assemblies to the number and type of electrical conductors in the cable within which they are associated, while minimizing the number of different parts associated with making up the plug and receptacle. Further, it is desirable to facilitate repair of defective portions of plug and receptacle combinations, while minimizing the number of repair parts that must be carried in inventory. This is particularly true in high current applications, such as in power distribution systems for distributing power to mining equipment and the like. At the same time, while minimizing the number of parts required for the plug and receptacle, it is very important in such high current applications to insure low resistance electrical connections, so as to prevent hot spots and the like developing due to the presence of the high current.

BRIEF SUMMARY OF THE INVENTION

Accordingly, it is an object of this invention to provide a plug and receptacle combination in which the number of necessary different parts are minimized.

It is another object of this invention to provide a plug and receptacle assembly in which cable terminals are an integral part of the male and female inter-engagable contacts.

It is another object of this invention to provide a plug and receptacle assembly in which identical insulators are used in the plug and receptacle.

It is another object of this invention to provide an electrical plug in which a housing is formed of identical housing halves.

It is another object of this invention to provide an electrical receptacle which includes female contact members that are segmented to assure multiple contact points to an interengagable male contact.

It is another object of this invention to provide an electrical receptacle having generally U-shaped female contact members, with separate spring means being provided for urging the legs of the U-shaped portion to tightly grip a male contact.

Briefly, in accordance with one embodiment of the invention, there is provided an electrical connector pair including a male plug and a female receptacle adapted for engagement to complete an electrical circuit. A male plug housing and a female receptacle housing are provided. Two identical insulators are provided, each insulator having a plurality of contact compartments. Means are provided for securing a first one of the insulators in the male plug housing and the second one of the insulators in the female receptacle housing. A plurality of male electrical contacts are provided, each having at least one blade portion at one end and an integral cable terminal at the other end. Means are provided for mounting the male electrical contacts in respective ones of the contact compartments of the first insulator. A plurality of female electrical contacts are provided, each having at least one generally U-shaped portion at one end and an integral cable terminal at the other end. Means are provided for mounting the female electrical contacts in respective ones of the contact compartments of the second insulator.

Other objects and advantages of the present invention will appear from the detailed description which appears hereinafter, taken in conjunction with the accompanying drawings.

BRIEF DESCRIPTION OF THE DRAWINGS

FIG. 4 is a side elevation view of the insulator of FIG. 3;

DETAILED DESCRIPTION

Figure 1:
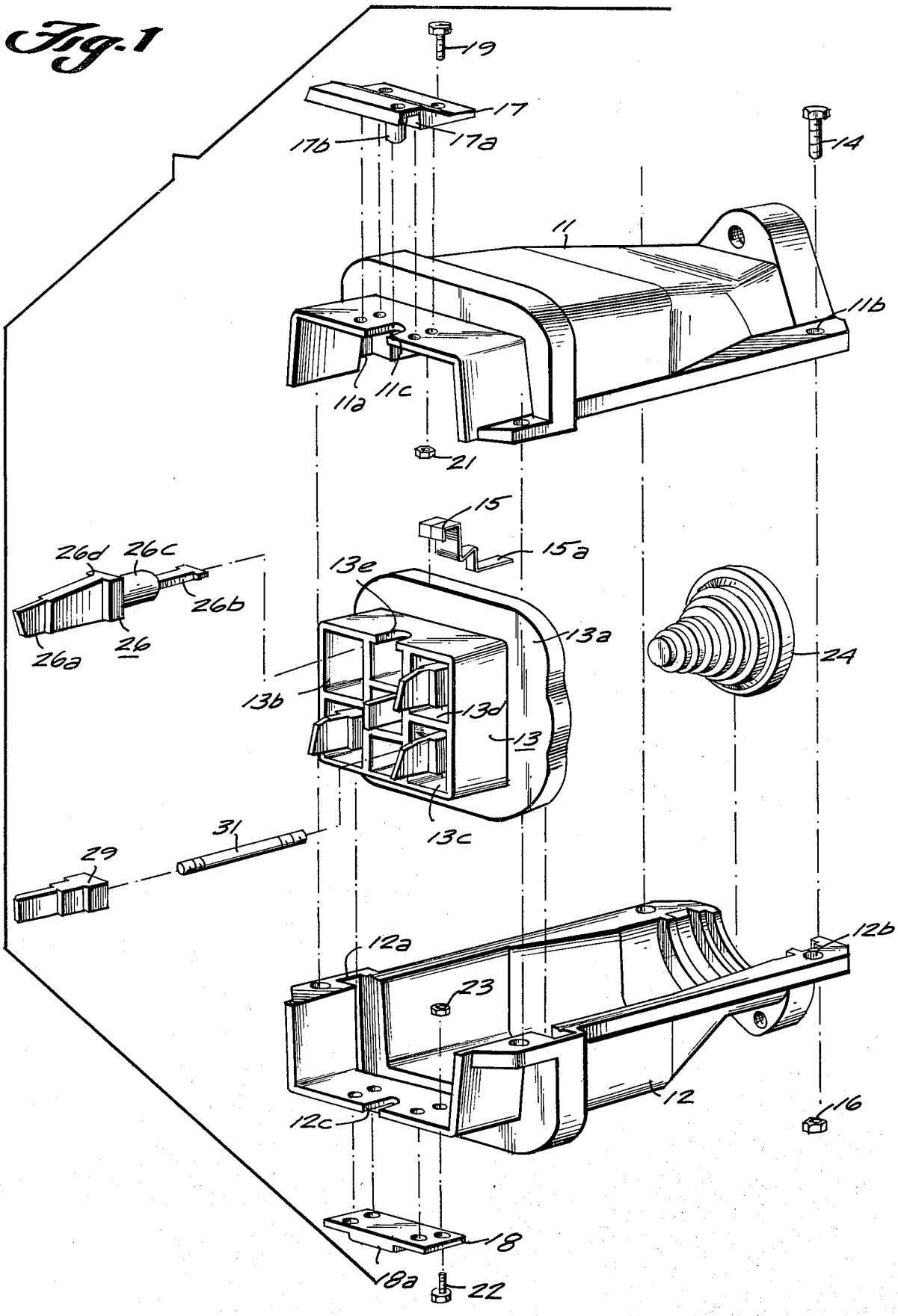
FIG. 1 is an exploded view of an electrical plug assembly in accordance with the invention.

Turning now to a description of preferred embodiments of the invention, FIG. 1 illustrates an exploded view of one embodiment of a male electrical plug in accordance with the invention. The male electrical plug comprises two identical housing halves 11 and 12. These housing halves can be conveniently formed of a casting or the like, and production tooling costs are minimized by having the housing halves 11 and 12 identical. The housing halves are provided with recesses 11*a* and 12*a* for capturing a collar portion 13*a* of an insulator 13. The housing halves 11 and 12 are adapted to be secured together through means such as bolt 14 and nut 16 passing through bolt holes such as 11*b* and 12*b* provided in the housing halves. In assembled form, the housing captures and mounts the insulator 13 through cooperation of the collar portion 13*a* thereof with the recesses 11*a* and 12*a* formed in the housing halves.

Since the plug housing halves 11 and 12 are identical, means have to be provided for discriminating between the top and bottom of the plug so as to insure appropriate orientation of the plug when connecting it to a receptacle. To this end, a top determining portion 17 and a bottom determining portion 18 are provided as shown in FIG. 1. Means are provided such as bolt 19 and nut 21 for securing the top determining portion 17 to the housing half 11. Likewise, means are provided such as bolt 22 and nut 23 for securing the bottom determining portion 18 to the housing half 12.

As shown in FIG. 1, the top determining portion 17 includes a detent portion 17*a*. In a manner discussed hereafter, this detent portion is engagable with a bar provided as part of a receptacle for providing a pivot point for assisting engagement of the plug to a receptacle.

As also shown in FIG. 1, each of the housing halves 11 and 12 includes a slot 11*c*, 12*c*. A pin portion 17*b* is provided on the top determining member 17, and when the top determining member 17 is secured to the housing half 11 the pin 17*b* sticks down through the slot 11*c*. Referring to the bottom determining member 18, it can be seen from an inspection of FIG. 1 that upon assembling the bottom determining portion 18 to the housing half 12 the slot 12*c* is covered thereby. The bottom determining member 18 does have a raised latch portion 18*a*, which cooperates with a latch provided on a receptacle for latching a plug to a receptacle in a manner discussed hereinafter.

As shown in FIG. 1, the insulator 13 is provided with a plurality of contact compartments, generally indicated in FIG. 1 by reference numerals 13*b*, 13*c*, 13*d*, etc. One side of the insulator 13 has a keyway formed therein, generally indicated in FIG. 1 by reference numeral 13*e*. The keyway 13*e* is provided in the insulator 13 for engagement with the pin 17*b* on the top determining member 17. Provision of this pin and keyway insures that the insulator is assembled in the housing halves right-side-up.

FIG. 1 illustrates a universal grommet 24 which can be provided for capture between the housing halves at the end where a cable enters the plug. The universal grommet can be of a rubber or plastic insulating material, and is shown in FIG. 1 as having stepped portions. To adapt the grommet to any size cable, it is only necessary to cut off the grommet at a stepped portion whose diameter matches that of the cable to which the plus is being assembled. Use of a universal grommet also aids in minimizing the number of different parts necessary for assembling plugs to different size cables.

Figure 6:
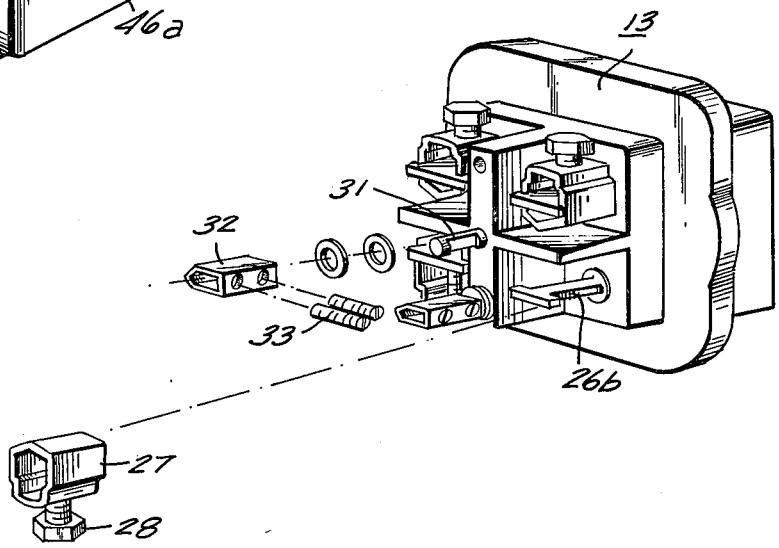
FIG. 6 is an exploded view illustrating the cable terminal portions of either the male or female electrical contacts.
Figure 5:
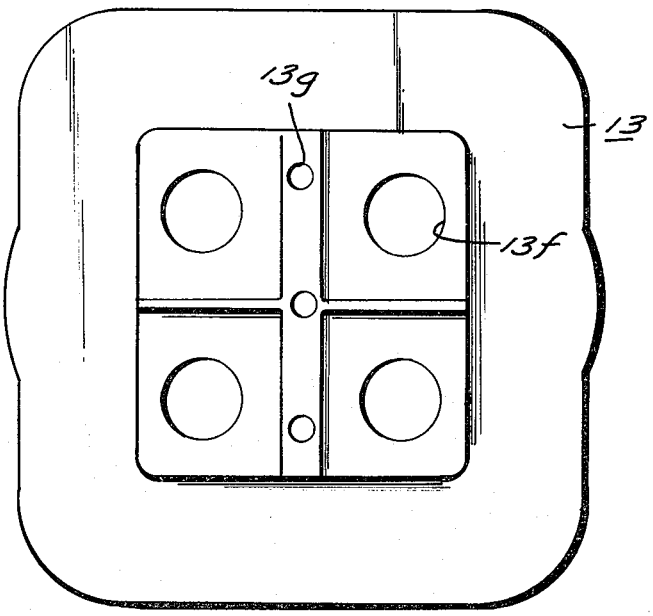
FIG. 5 is a real elevation of the insulator of FIG. 3.

Considering now FIG. 1 in conjunction with FIG. 6, FIG. 1 illustrates the contact side of insulator 13 and FIG. 6 illustrates the cable terminal side of the insulator 13. A plurality of male electrical contacts 26 can be provided for mounting within the contact compartments of insulator 13. As shown in FIG. 1, each of the male contacts 26 includes a blade portion 26*a* at one end thereof and an integral cable terminal portion 26*b* at the other end thereof. The male electrical contact 26 also include a generally cylindrical portion 26*c* provided intermediate the blade and cable terminal portions. The cylindrical portion 26*c* slidingly fits through openings 13*f* (FIG. 5) provided in insulator 13. A flange portion 26*d* is provided on the male electrical contact to abut the contact side of insulator 13 adjacent to opening 13*f*.

As shown in the drawings, the integral cable terminal of the male electrical contacts 26 is generally in a T shape. As shown in FIG. 6, conductor clamps 27 are provided for assembly on to the T shaped cable terminal. The conductor clamps 27 have a bolt 28 threadably secured therein, and serve two functions. First, the dimensions of the conductor clamps 27 are such that its width is less than the top or bar of the T shaped cable terminal portion. In order to assemble the conductor clamps 27 to the cable terminal portions, the bolt 28 is threaded out of the conductor clamp 27, and the conductor clamp 27 is oriented so that the diagonal dimension of its opening will permit it to slip over the top or bar of the T-shaped cable terminal portions. Then, upon properly orienting the conductor clamps 27, the conductor clamps are prevented from slipping off the cable terminal portions, with the bolts 28 being threaded into the conductor clamps 27 to maintain the proper orientation of the conductor clamps with respect to the cable terminal portions. The presence of the conductor clamps 27 also serves to capture the male electrical contacts 26 in assembled relation in the insulator 13. When a conductor is assembled to any of the cable terminal portions 26*b*, the conductor is inserted into the conductor clamp 27 and bolt 28 is tightened down on the conductor, to assure positive contact between the conductor and the cable terminal portion 26*b*.

The importance of the cable terminal portion being an integral part of contact 26 is twofold. First, if one of the contacts fails, it is very easy to replace the contact. Secondly, "hot spots", which have occurred in prior art constructions, are eliminated. Previous designs have utilized a threaded hole on the back of the electrical contact members into which a threaded stud is screwed. Then a cable terminal is screwed onto this stud, and held in place with one or more set screws. Both threaded joints are potential hot spots. In accordance with the present invention, since the cable terminal is an integral part of the contact, these potentially troublesome hot spots are eliminated.

If desired, the prior art construction utilizing a threaded stud can be utilized for making connections wherein high current carrying ability is not necessary. Thus, in FIG. 1 there is illustrated a contact block 29 into which one end of a threaded stud 31 is screwed. The other end of the threaded rod extends through apertures such as 13*g* in the insulator 13 and extends out the other side of insulator 13. A cable terminal 32 is screwed onto this other end of the threaded rod 31 and held in place with one or more set screws 33.

Also, if desired, a ground clip 15 having a terminal portion 15*a* can be provided for grounding the plug housing. As shown in FIG. 1, this ground clip can be captured and retained between the insulator collar portion 13*a* and the housing half 11.

Figure 2:
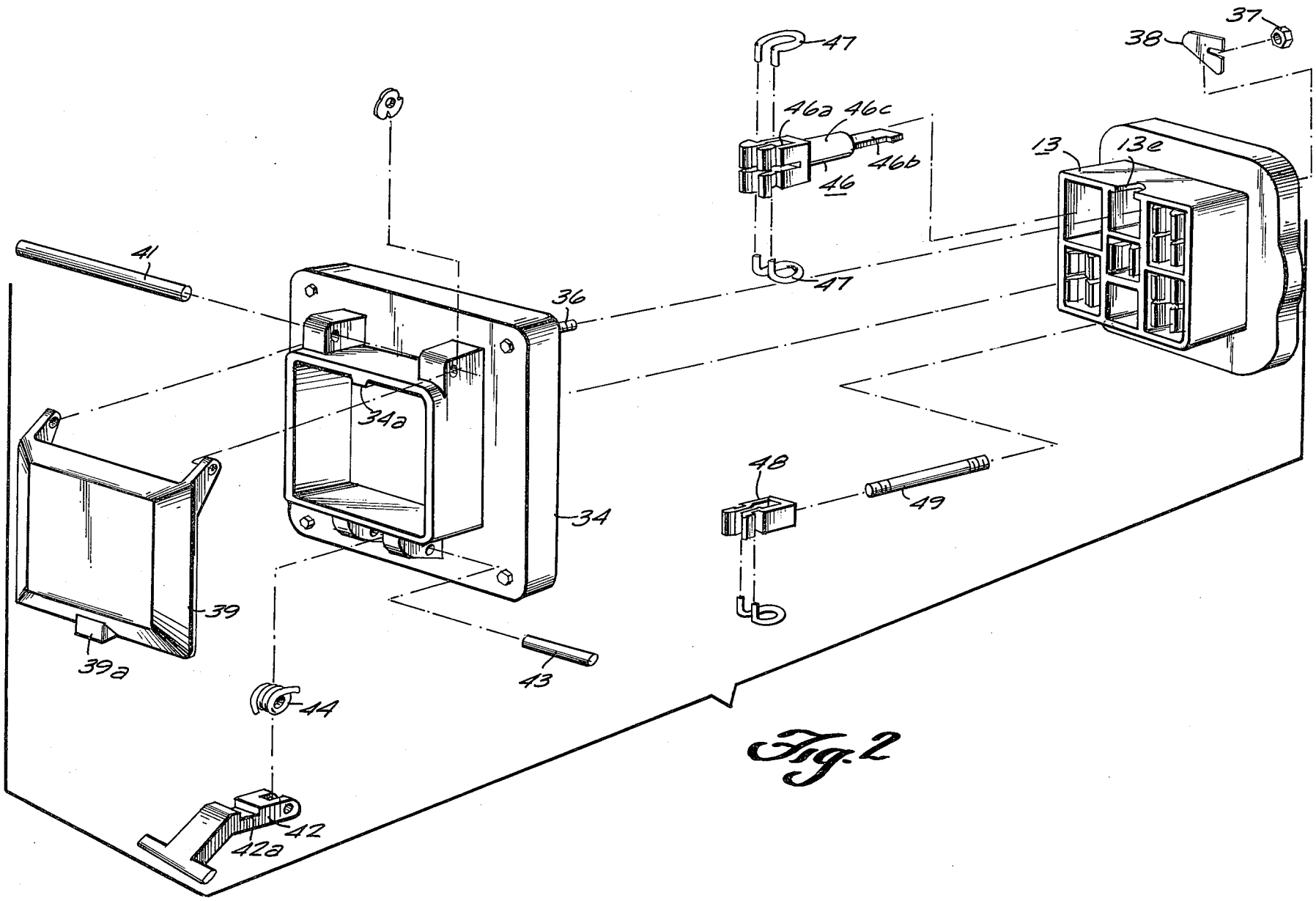
FIG. 2 is an exploded view of a female electrical receptacle in accordance with the invention.
Figure 1:
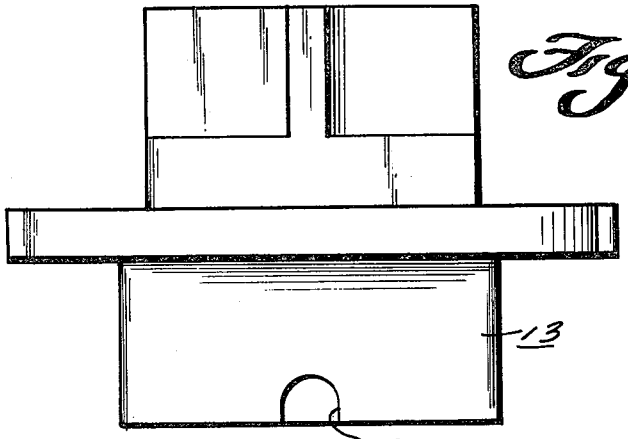
Figure 3:
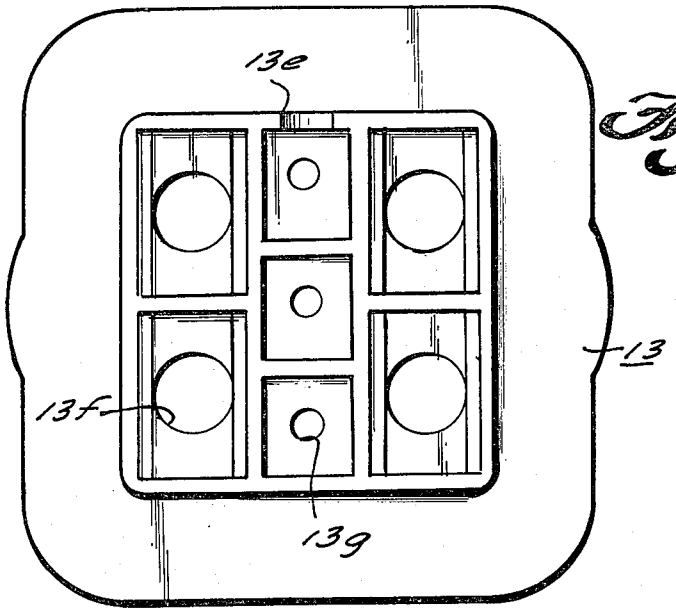
FIG. 3 is a front elevation of the identical insulator used in both the plug and receptacle of FIGS. 1 and 2.
Figure 8:
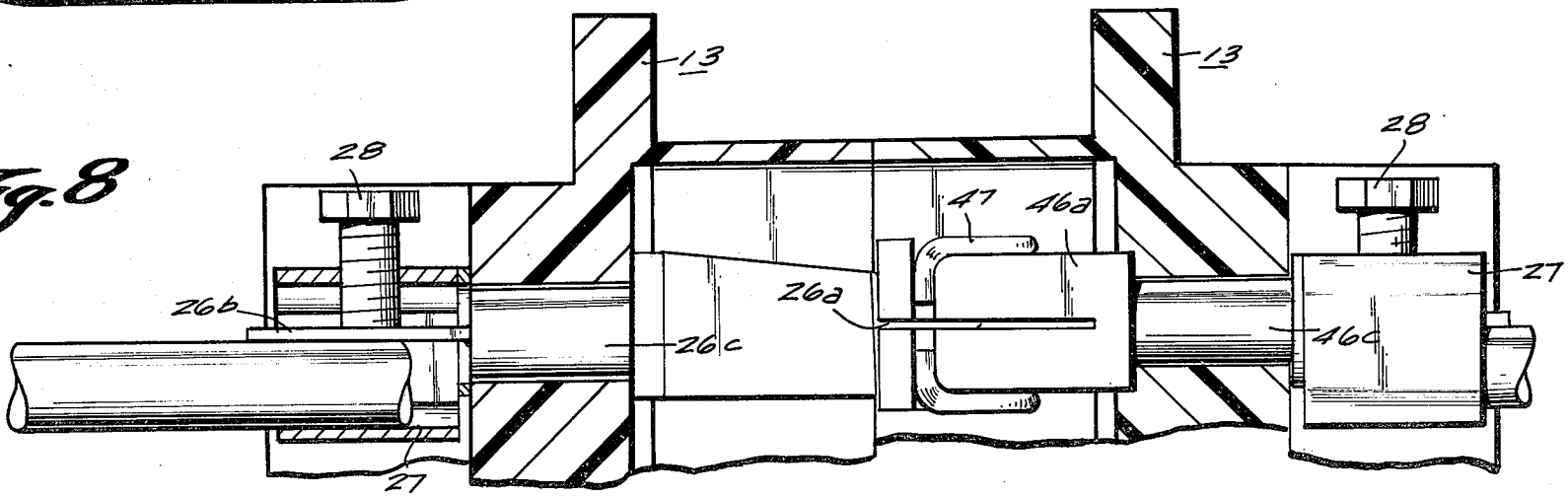
FIG. 8 is a sectional view showing portions of a plug and receptacle inter-engaged with each other.

Turning now to a consideration of FIG. 2, there is shown an exploded view of the female receptacle in accordance with one embodiment of the invention. As shown in the drawing, a female receptacle housing 34 is provided. An insulator 13 is provided which, in accordance with the invention, is identical to the insulator used in the male plug assembly, thus minimizing manufacturing and inventory costs. The insulator 13 is suitably secured in the housing 34 by means such as bolts 36, nuts 37, and clamping plates 38.

The insulator 13 includes a keyway 13*e*, as before. The female receptable housing 34 is provided with a key in the form of a boss or pin 34*a* for engagement in the keyway 13*e*, so as to insure correct assembly of the insulator 13 to the housing 34.

The female receptacle housing 34 can include a coverplate 39 which covers the receptacle when it is not engaged by a plug. The coverplate 39 is mounted to the receptacle housing 34 by means of a rod or bar 41. This rod or bar 41 serves two purposes. First, it obviously mounts the coverplate 39. Second, the bar 41 is adapted to engage within the detent 17*a* of the top determining member 17 on the plug assembly shown in FIG. 1. This assures that the top of the plug assembly is mated with the top of the receptacle assembly, and also serves as a pivot point for facilitating inter-engagement of a plug with a receptacle.

As also shown in FIG. 2, a latch member 42 is mounted by a pin 43 to the receptacle housing 34. A spring 44 can be provided surrounding the pin 43 for spring biasing the latch 42. When no plug is engaged in the receptacle, the latch 42, which has a detent or recess 42*a*, engages a latch surface 39*a* on the cover 39, for securely latching the cover 39 in a closed position on the receptacle. When, on the other hand, the plug assembly of FIG. 1 is engaged in the receptacle assembly of FIG. 2, the raised latch portion 18*a* of the bottom determining member 18 is engaged in the recess 42*a* of latch 42. This securely locks the plug in assembled relation to the receptacle and prevents inadvertent dislodging thereof.

Figure 7:
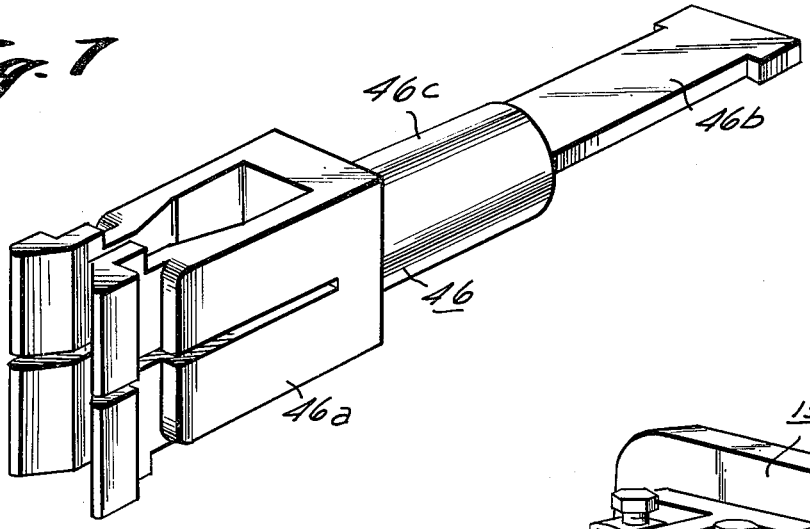
FIG. 7 is a larger view of the female electrical contact shown in FIG. 2.

FIG. 2 (and FIG. 7 as well) show details of the female electrical contacts which are provided in compartments of the insulator 13 in accordance with the present invention. The female electrical contacts 46 include at one end a generally U-shaped portion 46*a* and at the other end a T-shaped cable terminal portion 46*b*. In accordance with the invention, the cable terminal portions 46*b* are integral with the U-shaped portions 46*a*, and are separated by a generally cylindrical portion 46*c*. As shown in the drawings, in accordance with one embodiment of the invention, the legs of the U-shaped portion 46*a* are segmented. Further, each of the segmented portions is provided with its own spring means 47 for resiliently biasing the legs of the U-shaped portion toward each other. By providing at least two segments to the female contact, the possible contact points between the female contact and the blade of an inter-engaged male contact are doubled, thus reducing the possibility of "hot spots" from the high current passing therethrough.

As shown in FIG. 2, it is possible to include a threaded rod and contact arrangement as part of the receptacle in the same manner as provided before in connection with the plug assembly. Thus, FIG. 2 illustrates the case where a contact block 48 is provided which threadably is secured to one end of a rod 49. The other end of the threaded rod extends through apertures 13*g* in the insulator 13, and is secured thereto by the same arrangement as illustrated in FIG. 6, i.e. by a cable terminal 32 which is held in place with one or more set screws 33.

The female electrical contacts 46 are retained in place on insulator 13 by the same means as are the male electrical contacts 26. Thus, FIG. 6 also serves as an illustration of the manner in which conductor clamps 27 and bolts 28 engage the T-shape cable terminal portions of the female electrical contacts to both retain the contacts in assembled relationship in the insulator 13, and also to make electrical contact between conductors and the T-shaped cable terminal portions 46*b*.

Thus, what has been described thus far, is an improved plug and receptacle assembly in which the number of different individual parts necessary from a manufacturing and inventory standpoint is reduced by utilizing identical insulators for both the plug and receptacle assemblies. Further, the plug is assembled using identical housing halves, with top and bottom determining portions secured thereto for defining a top and bottom of the plug. Means are provided on the receptacle and plug to cooperate for pivoting the plug on the receptacle and latching the plug in place upon inter-engagement with the receptacle. Further, the cable terminal portions of the electrical contacts of both the plug and receptacle are integral with the contact portions, thus making it easy to change them in case of failure and serving to eliminate "hot spots" in the contact assembly. Further, the identical insulator which is used in the plug and receptacle has a key way therein, and means are provided on both the receptacle housing and the plug housing constituting a key or pin to insure correct assembly of insulators to the housings.

Figure 9:
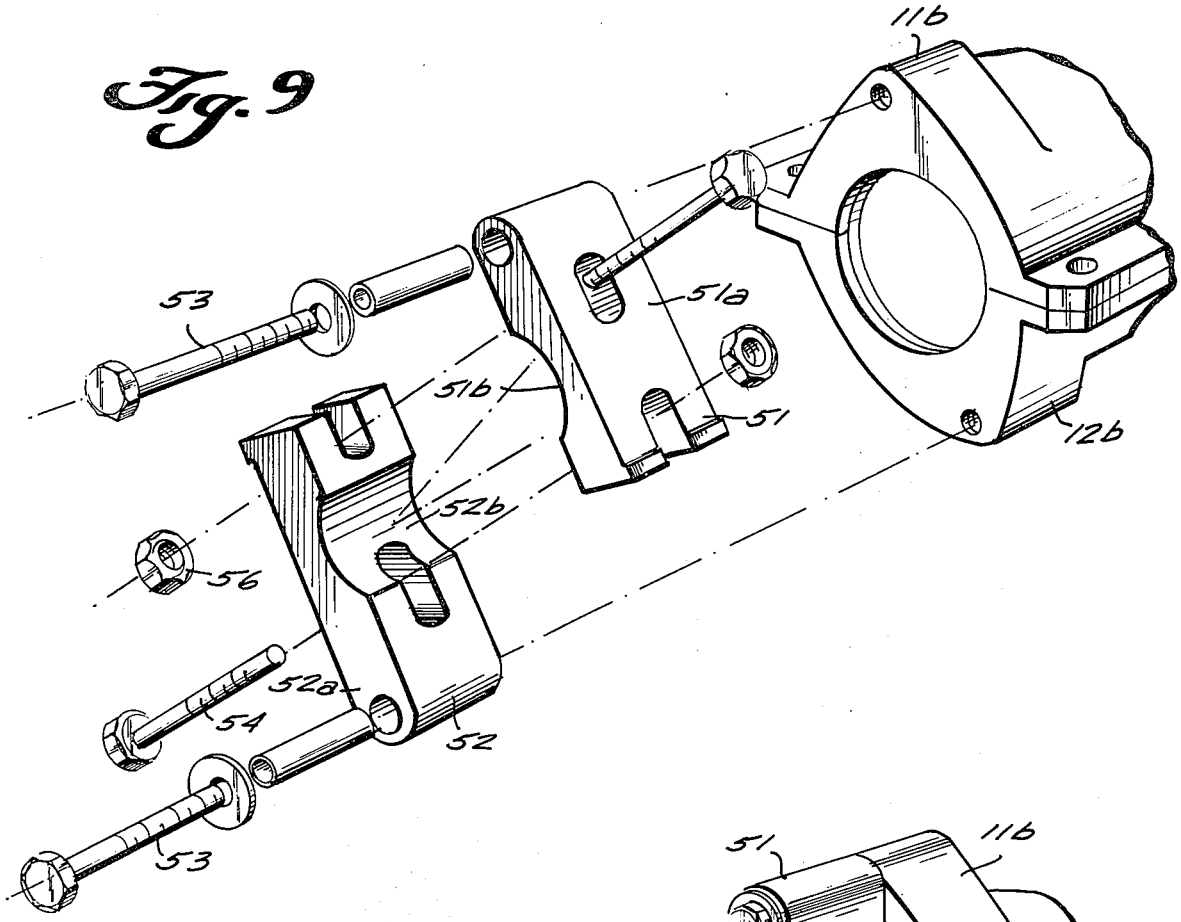
FIG. 9 is an exploded view showing a cable clamp associated with the plug of FIG. 1.
Figure 10:
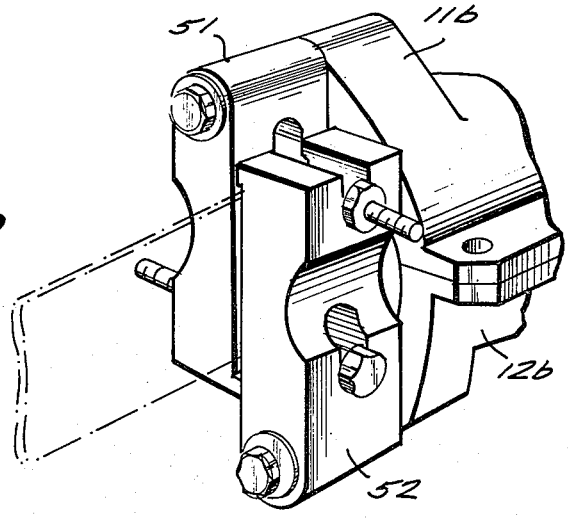
FIG. 10 is an illustration of the reversible nature of the cable clamp of FIG. 9 for clamping flat cables.

Turning now to a consideration of FIGS. 9 and 10, there is shown another feature of one embodiment of a plug assembly provided in accordance with the present invention. This feature relates to strain relief at the end of the plug assembly (housing halves 11*b* and 12*b*) through which a multiple conductor cable passes. As shown in the drawings, the cable clamp comprises two clamp halves 51 and 52 as shown in the drawings. These clamp halves can be identical, and they each have one flat side 51*a*, 52*a*, with the opposite sides 51*b*, 52*b* being arcuate in shape. Each of the clamp halves is secured by means such as bolts 53 to the two plug housing halves 11*b* and 12*b*. Means are provided such as bolts 54 and nuts 56 to tightly clamp the clamp halves 51 and 52 around the exterior of a cable passing therebetween. In accordance with the invention, FIG. 9 illustrates the orientation of the clamp halves 51 and 52 for clamping a round cable. Thus, in this configuration, the arcuate portions 51*b*, 52*b* clamp the cable. FIG. 10 illustrates the manner in which the clamp halves 51 and 52 can be used to suitably clamp a flat cable. Thus, in the configuration shown in FIG. 10, each of the clamp halves 51 and 52 is rotated 180° from their positions in FIG. 9, so that the flat faces of each of the clamp halves face each other. This permits secure clamping of a flat cable therebetween.

Since each of the clamp halves 51 and 52 provided in accordance with the invention is identical, again the number of parts is minimized from both the manufacturing and inventory standpoint. Moreover, since the clamp assembly shown in FIGS. 9 and 10 is universal, i.e., it clamps both round cables and flat cables, it is not necessary to either manufacture or inventory a number of different clamps suited for clamping cables of differing cross sectional configurations.

Figure 11:
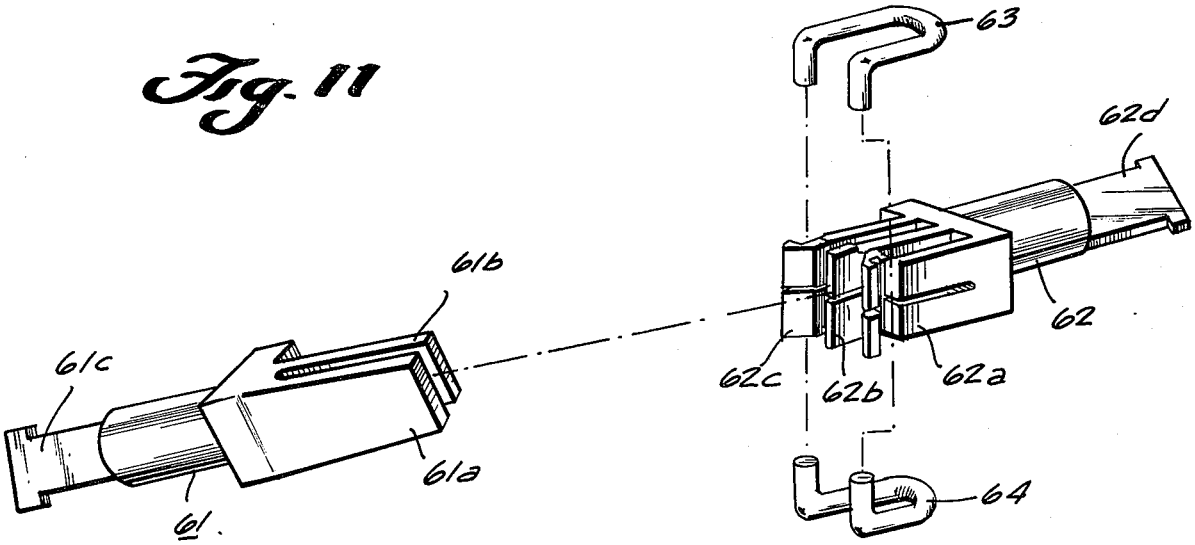
FIG. 11 is an illustration of an alternate embodiment of male and female contact members.

Referring now to FIG. 11, there is shown an illustration of an alternate embodiment of male and female contact members. In FIG. 11, the male contact member 61 is provided with two blade portions 61*a* and 61*b*. In this embodiment the contact member is still provided with a T-shaped integral cable terminal portion 61*c*. The female contact member 62 is provided with three segmented members 62*a*, 62*b* and 62*c*, which define two U-shaped portions for receiving the blade portions 61*a* and 61*b* of the male contact member. As in the other embodiment, the female contact member is provided witn a T-shaped integral cable terminal portion 62*d*, and spring members 63 and 64 are provided for resiliently biasing the legs of the U-shaped portions into tight engagement with the male contact blade portions.

It should be apparent to those skilled in this art, from the foregoing discussion, that many variations in specific configurations of the plug and receptacle assemblies discussed above are possible without departing from the true spirit and scope of the invention. The above detailed discussion has been directed toward presently preferred embodiments of the invention, and it is not meant to limit the scope of the invention to these presently preferred embodiments.

I claim:

1. In combination, an electrical connector pair comprising a male plug and a female receptacle adapted for engagement to complete an electrical circuit comprising a male plug housing, and a female receptacle housing;

two identical one-piece insulators, each having a plurality of contact compartments, means securing a first one of said insulators in said male plug housing, and means securing a second one of said insulators in said female receptacle housing; top and bottom determining members for mounting on said male plug housing for defining a top and bottom of said male plug housing, said female receptacle housing including a top determining member and said insulators having a keyway in their top portion which cooperates with said top determining members of said male and female housings to insure correct assembly of said insulators therein, a plurality of male electrical contacts each having at least one blade portion at one end and an integral cable terminal at the other end, means mounting said male electrical contacts in respective ones of the contact compartments of said first insulator, a plurality of female electrical contacts, each having at least one generally U-shaped portion at one end and an integral cable terminal at the other end; and means mounting said female electrical contacts in respective ones of the contact compartments of said second insulator.

2. An electrical connector pair in accordance with claim 1 wherein said female electrical contacts have their U-shaped portions split into at least two segments for assuring multiple contact points to a male electrical contact blade portion when inserted therein, and including spring means for each of said at least two segments for biasing legs of said U-shaped portions to tightly grip a male electrical contact blade portion when inserted therein.

3. An electrical connector pair in accordance with claim 1 wherein said means for mounting said male electrical contacts and said female electrical contacts include apertures in said insulators through which a generally cylindrical middle portion of said male and female electrical contacts pass, and conductor clamps mounted on the integral cable terminal portions of said male and female electrical contacts.

4. An electrical connector pair in accordance with claim 1 wherein said male plug housing comprises two identical castings, and means for securing said identical castings together surrounding and mounting said first insulator.

5. An electrical connector pair in accordance with claim 4 includes means securing said top determining member to one of said identical castings and said bottom determining member to the other of said identical castings.

6. An electrical connector pair in accordance with claim 5 wherein said top determining member includes a detent portion and in which said female receptacle housing includes a bar at its top portion, said detent portion being engageable with said bar during engagement of said male plug and female receptacle to both insure correct engagement and to provide a pivot point for assisting engagement.

7. An electrical connector pair comprising a male plug and a female receptacle adapted for engagement to complete an electrical circuit comprising a male plug housing and a female receptacle housing;

two identical insulators, each having a plurality of contact compartments, means securing a first one of said insulators in said male plug housing, and means securing a second one of said insulators in said female receptacle housing;

a plurality of male electrical contacts each having at least one blade portion at one end and an integral cable terminal at the other end, means mounting said male electrical contacts in respective ones of the contact compartments of said first insulator, a plurality of female electrical contacts, each having at least one generally U-shaped portion at one end and an integral cable terminal at the other end; and means mounting said female electrical contacts in respective ones of the contact compartments of said second insulator, said male plug housing including a cable clamp for physically clamping the exterior of a cable having conductors connected to said male electrical contact cable terminals, and wherein said cable clamp comprises two clamp halves, each having an arcuate side and a flat side, and securing means for selectively securing said clamp halves arcuate side to arcuate side for clamping a round cable or flat side to flat side for clamping a flat cable, said securing means also serving to secure said cable clamp to said male plug housing.

8. A male electrical plug comprising a male plug housing, an insulator having a plurality of contact compartments, means securing said insulator in said plug housing, a plurality of male electrical contacts each having at least one blade portion at one end and an integral cable terminal at the other end, means mounting said male electrical contacts in respective ones of said contact compartments, said male plug comprising two identical housing halves, and means for securing said two housing halves together surrounding said insulator, a top determining member and a bottom determining member and means securing said top determining member to one of said housing halves and said bottom determining member to the other of said housing halves, and a cable clamp adapted to clamp the exterior of a cable, said cable clamp comprising two clamp halves, each having an arcuate side and a flat side, and securing means for selectively securing said clamp halves arcuate side to arcuate side for clamping a round cable or flat side to flat side for clamping a flat cable.

* * * * *